US007451494B2

(12) United States Patent
Monroe et al.

(10) Patent No.: US 7,451,494 B2
(45) Date of Patent: Nov. 18, 2008

(54) PROTECTIVE BIB FOR USE BY A TRAVELER

(76) Inventors: Keith Monroe, 2902 Spartacus Dr., Grand Prairie, TX (US) 75052; Lloyd Nelson, 3102 Oaktown Ave., #700, Dallas, TX (US) 75219

( * ) Notice: Subject to any disclaimer, the term of this patent is extended or adjusted under 35 U.S.C. 154(b) by 0 days.

(21) Appl. No.: 12/046,203

(22) Filed: Mar. 11, 2008

(65) Prior Publication Data

US 2008/0148462 A1 Jun. 26, 2008

Related U.S. Application Data

(63) Continuation-in-part of application No. 11/874,689, filed on Oct. 18, 2007, which is a continuation of application No. 11/120,533, filed on May 3, 2005, now abandoned.

(51) Int. Cl.
*A41B 13/10* (2006.01)

(52) U.S. Cl. ..... 2/49.1

(58) Field of Classification Search ..... 2/48, 2/49.1–49.5, 46, 47, 50, 51, 52, 69, 104, 2/102, 174, 207, 118–120; 297/482, 219.12, 297/256.15, 465, 487, 488, 182; 280/801.1
See application file for complete search history.

(56) References Cited

U.S. PATENT DOCUMENTS

D212,581 S * 11/1968 Ratay ..... D2/864
3,601,815 A * 8/1971 Strehlan ..... 2/48
4,660,224 A * 4/1987 Ashcraft ..... 2/48
4,678,205 A * 7/1987 Wold ..... 280/808
4,693,495 A * 9/1987 LaPointe ..... 280/808
4,712,251 A * 12/1987 Cobble ..... 2/104
5,008,960 A * 4/1991 Hemming ..... 2/104
5,178,439 A * 1/1993 McCracken ..... 297/482
5,476,697 A * 12/1995 Bellander ..... 2/49.3
5,573,153 A * 11/1996 Stillman ..... 224/148.6
5,621,916 A * 4/1997 Bell ..... 2/48
5,701,605 A * 12/1997 Bowen ..... 2/49.1
5,956,763 A * 9/1999 Blackshear ..... 2/49.1
5,960,472 A * 10/1999 Reid ..... 2/48
6,079,048 A * 6/2000 Campbell ..... 2/49.1
6,317,890 B1 * 11/2001 Kuhn ..... 2/52
6,322,149 B1 * 11/2001 Conforti et al. ..... 297/482
6,394,554 B1 * 5/2002 Hingle ..... 297/482
6,484,333 B1 * 11/2002 Hill ..... 5/483
6,783,185 B1 * 8/2004 Sutton et al. ..... 297/482
6,826,780 B1 * 12/2004 Romesburg ..... 2/49.2
6,839,907 B2 * 1/2005 Katz ..... 2/48
7,048,160 B2 * 5/2006 Anderson ..... 224/148.6
2002/0074847 A1 * 6/2002 Terpselas ..... 297/483
2005/0225135 A1 * 10/2005 Moses ..... 297/228.1
2007/0199123 A1 * 8/2007 Friedland et al. ..... 2/49.1

* cited by examiner

*Primary Examiner*—Amy B Vanatta
(74) *Attorney, Agent, or Firm*—Michael A. O'Neil

(57) ABSTRACT

A protective bib for safeguarding clothing of a user from spills, stains, or burns, while eating, drinking, or smoking while traveling in a vehicle, train, plane, bus, boat, or other mode of transportation having or not having a diagonally extending seat belt. The protective bib has a protective covering generally trapezoidal in shape, including a top edge, a top liner, and a non-permeable bottom liner. An adhesive secures the top and bottom liners together. The top edge extends diagonally across the chest of the user and has a self-contained textile adhesive envelope-like flap which secures the bib in place.

1 Claim, 2 Drawing Sheets

PROTECTIVE BIB FOR USE BY A TRAVELER

CROSS-REFERENCE TO RELATED APPLICATION

This application is a continuation-in-part of application Ser. No. 11/874,689 filed Oct. 18, 2007, currently pending, the entire contents of which are incorporated herein by reference, which is a continuation application of application Ser. No. 11/120,533 filed May 3, 2005, now abandoned, the entire contents of which are incorporated herein by reference.

TECHNICAL FIELD

The present invention relates generally to protecting garments worn by travelers and more particularly to a protective bib which extends across the chest, waist, and upper legs of a traveler and is secured to a seatbelt or the travelers clothing by opening the protective bib's self-contained textile envelope-like adhesive flap when a seatbelt is not present.

BACKGROUND OF THE INVENTION

The invention relates to a protective covering, and more particularly, to a protective bib for safeguarding clothing from spills, stains, or burns, while eating, drinking, or smoking when traveling in a vehicle, train, plane, bus, boat, or the like.

Many individuals eat, drink, or smoke while driving in a vehicle. Those who smoke or eat while traveling often have debris such as food or tobacco products drop onto their clothing or vehicle seat. Such debris usually fall upon the lap of the person seated, soiling his/her garments. In addition, burning tobacco from cigarettes, cigars, or pipes can ruin clothing and may even injure the traveler. The protective bib's self-contained textile adhesive envelope-like flap will not be hazardous to seatbelt or traveler's clothing.

U.S. Pat. No. 5,181,275 to Spulgis discloses an apron to be used in a seated position. U.S. Pat. No. 5,621,916 to Bell discloses a bib for use while operating a vehicle. U.S. Pat. No. 6,484,333 to Hill discloses a fire retardant lap protection cloth. U.S. Pat. Nos. 5,075,897 to Daniels, 5,220,692 to Cox, 4,924,527 to Hintermeyer, 5,530,968 to Crockett, 5,956,763 to Blackshear disclose additional protective covering apparatuses. U.S. Pat. No. D311,445 to Dawahare discloses an ornamental design for a protective covering. Magellan's Catalog includes a product called "bigBib," as well.

While the articles disclosed in the above-listed patents and publications may be suitable for the particular purpose disclosed therein, or for general use, they would not be suitable for the purposes of the present invention as disclosed hereafter.

SUMMARY OF THE INVENTION

It is an object of the invention to provide means for safeguarding clothing from spills, stains, or burns while eating, drinking, or smoking when traveling. Accordingly, the invention is a protective bib having a protective covering including a top edge, a top liner and a non-permeable bottom liner for safeguarding clothing from spills, stains, or burns while traveling.

It is another object of the invention to provide a convenient means of installing the protective bib. Accordingly, the top edge of the protective bib includes a self-contained textile adhesive envelope-like flap when open easily attaches to a seat belt or the travelers clothing when a seatbelt is not present for multiple uses.

It is another object of the invention to provide means for protecting the interior area around the user. Accordingly, the protective bib extends from a chest of the user to cover the waist, lap, and upper legs of the user as well as portions of the interior area surrounding the user including a floor area and seat.

This invention is a protective bib for safeguarding clothing of a user from spills, stains, or burns, while eating, drinking, or smoking while traveling in a vehicle, train, plane, bus, boat, or other mode of transportation having or not having a seat belt, being fully adaptive to any non-mobile traveler's surrounding, i.e., hotel, airport, public dining, and the like. The protective bib comprises a substantially trapezoidal protective covering, including a top edge, a top liner, and a non-permeable bottom liner. An adhesive secures the top and bottom liners together. The top edge has a self-contained textile adhesive envelope-like flap which extends angularly across the chest of the user and attaches to the seatbelt or the traveler's clothing when a seatbelt is not present.

A protective bib which accomplishes the above and related objects of the invention may be embodied in the form Illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
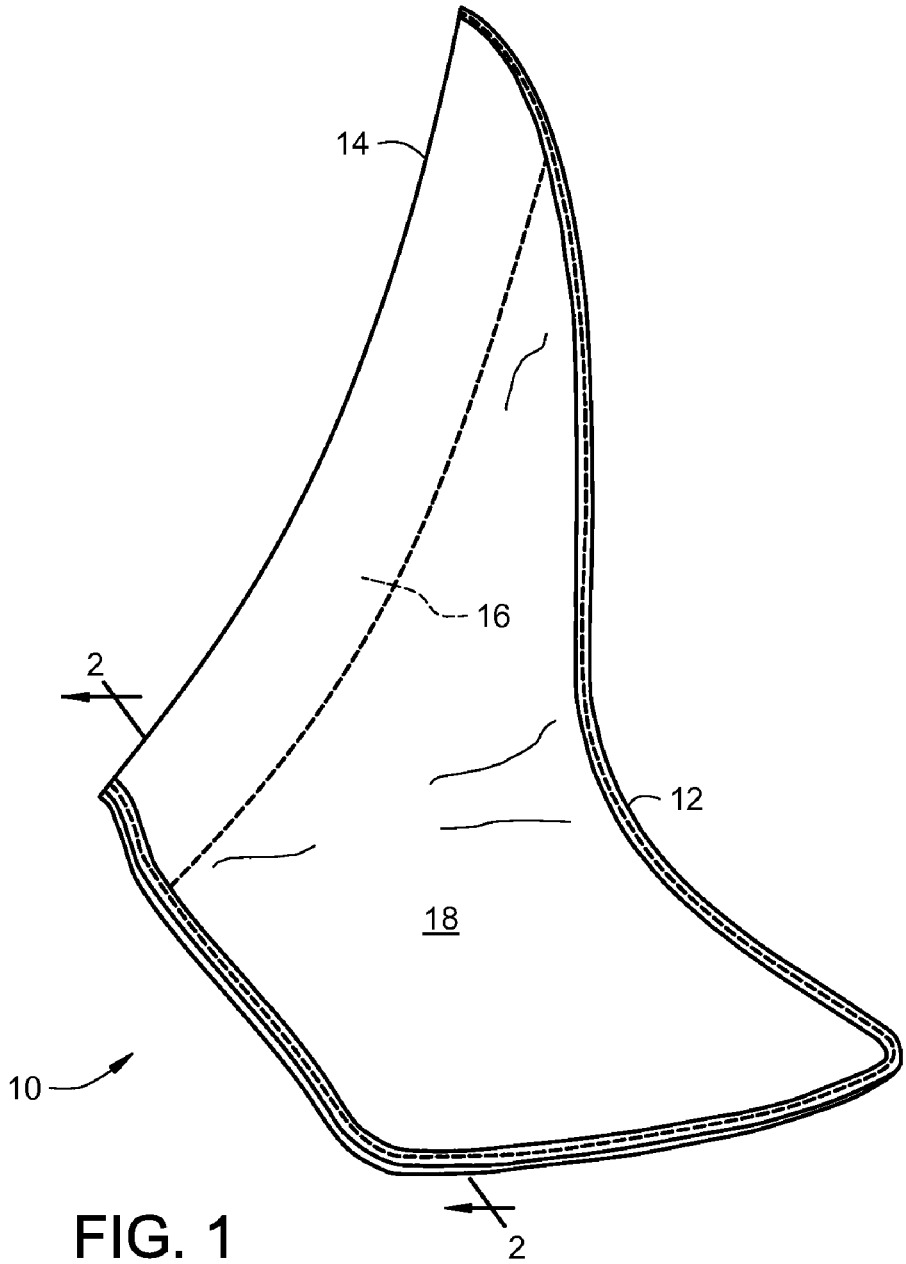
FIG. 1 is a diagrammatic perspective view of the protective bib of the present invention comprising a protective covering having a top edge, a top liner, and a non-permeable bottom liner.

FIG. 1 illustrates a protective bib 10 for safeguarding clothing of a user from spills, stains, or burns, while eating, drinking, or smoking when traveling in a vehicle, train, plane, bus, boat, or the like, including most other modes of transportation. The mode of transportation is equipped with an interior having seats and a floor, and a plurality of seat belts, each having either a lap belt or more preferably a cross-chest harness belt, as disclosed by the preferred embodiment. The protective bib 10 is for use by a user, seated in a vehicle, and having a chest, waist, lap, and upper legs.

The protective bib 10 has a protective covering 12 generally trapezoidal in shape. Preferably, the protective covering is thirty-six inches in length, and twenty-four inches in width. The protective covering 12 includes a top edge 14. The top edge 14 extends downwardly at an angle across the chest of the user and has a self-contained textile adhesive envelope-like flap 16 coupled therealong. The textile adhesive envelope-like flap 16 is for attachment of the protective bib to a cross-chest harness belt or the clothes of a traveler when a cross-chest harness belt is not present.

Figure 2:
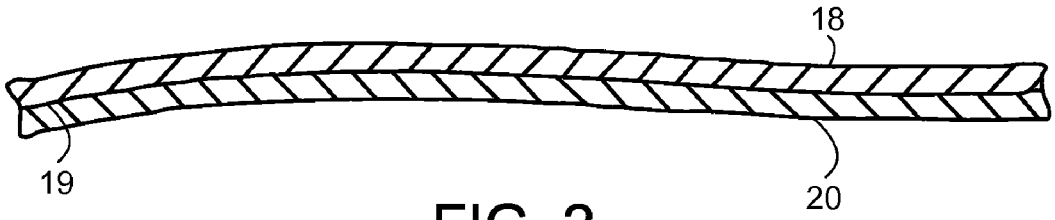
FIG. 2 is a cross-sectional view of the protective covering of the protective bib of the present invention having a top liner and a bottom liner for protecting clothing of the user.

FIG. 2 illustrates a cross-section of the protective covering 12 of the protective bib 10. The protective covering 12 includes a top liner 18 and a bottom liner 20 coupled together by an adhesive 19 for protecting clothing of a user. The top liner 18 is preferably made of a fabric material formed by weaving, knitting, pressing or felting natural or synthetic fibers. The top liner 18 catches all spills, stains, and burns thereon. The bottom liner 20 is preferably non-permeable and made of a plastic material for preventing liquid, stains, spills, or debris from passing therethrough. The bottom liner 20 therefore protects the clothing of the user from spills and stains.

Figure 3:
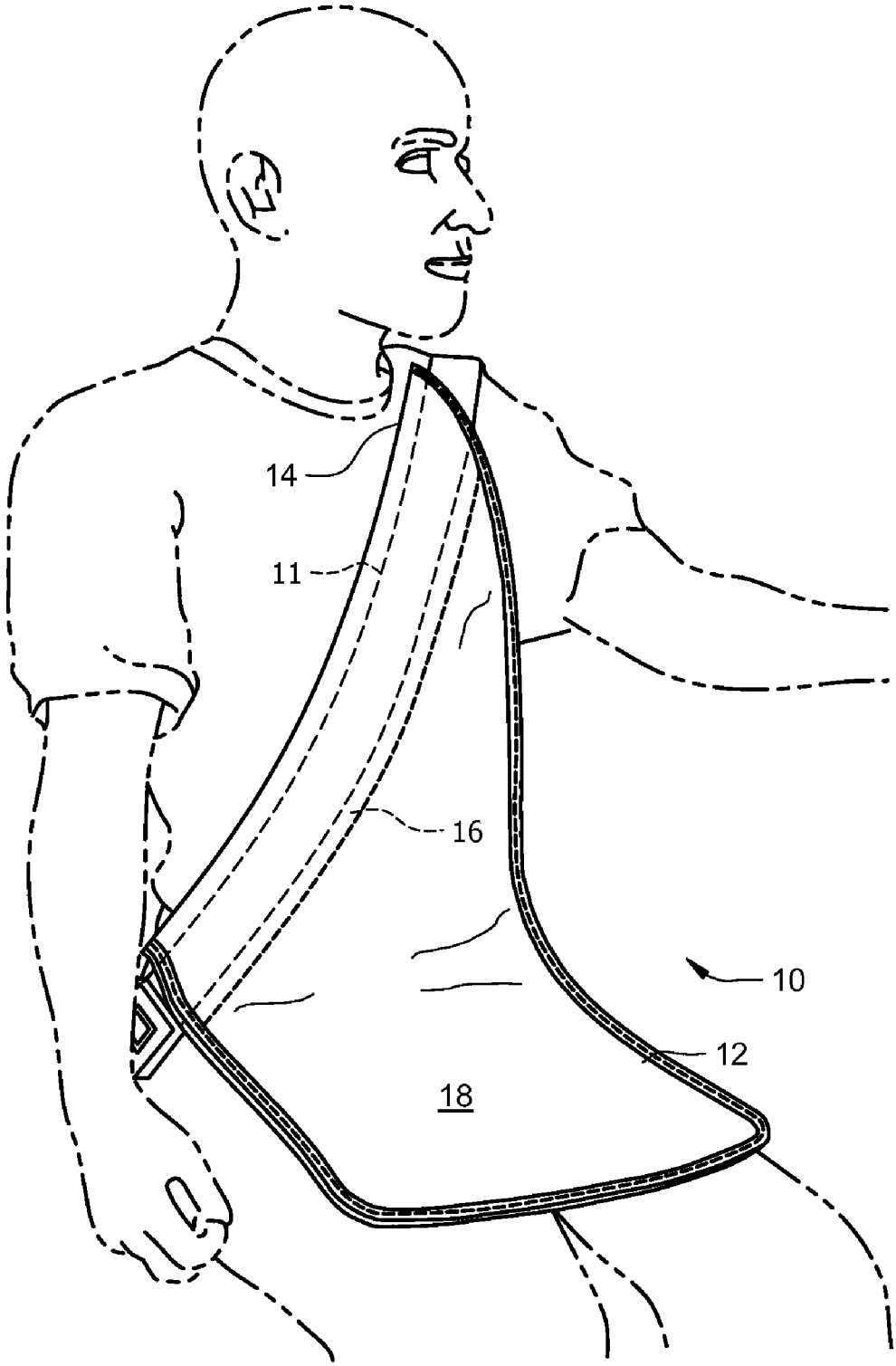
FIG. 3 is a diagrammatic perspective view of the protective bib of the present invention in use safeguarding clothing of a user from spills, stains, or burns while eating; drinking, or smoking while traveling.

FIG. 3 illustrates the protective bib 10 of the present invention in use safeguarding clothing from spills, stains, or burns, while eating, drinking, or smoking when traveling. Here, the user simply attaches the protective covering 12 to the seat belt 11 by means of the self-contained textile adhesive envelope-like flap 16 which extends behind the seat belt 11. Once in position, the protective covering 12 extends partially over the chest of the user, covering their waist, lap, and upper legs. In addition, the protective covering 12 may also protect portions of the interior at the mode of transportation, including the floor area and seats. The user is free to eat, drink, or smoke as necessary without having to worry about ruining his or her clothing. Once at a destination, the user simply removes the protective covering 12 from the seat belt 11 and closes the self-contained textile adhesive envelope-like flap, shakes the top liner 18 to remove any food or debris retrieved thereon.

The top liner 18 of the protective covering 12 conveniently catches all spills, stains, and burns before they ruin clothing of the user or the interior of the mode of transportation, and can be wiped clean with a sponge or towel.

In conclusion, herein is presented a protective bib for safeguarding clothing and asset protection of a user from spills, stains, or burns, while eating, drinking, or smoking when traveling. The invention is illustrated by example in the drawing figures, and throughout the written description. It should be understood that numerous variations are possible, while adhering to the inventive concept. Such variations are contemplated as being a part of the present invention.

The invention claimed is:

1. A protective bib for safeguarding clothing of a user from spills, stains, or burns, while eating, drinking, or smoking when seated in a mode of transportation, the user having a chest, waist, lap, and upper legs, the mode of transportation being equipped with or without a diagonally extending seat belt, comprising:

a protective covering being generally trapezoidal in shape for covering the waist, chest, lap, and upper legs of the user, having a top liner and a non-permeable bottom liner, said protective covering having a top edge extending diagonally downwardly across the chest of the user, the top edge having a self-contained textile adhesive envelope-like flap extending behind the seat belt for securing the protective covering in place; and an adhesive for coupling together the top and bottom liners.

* * * * *